US010753064B2

(12) United States Patent
Parker et al.

(10) Patent No.: US 10,753,064 B2
(45) Date of Patent: Aug. 25, 2020

(54) ARM FOR MATERIAL HANDLING MACHINE

(71) Applicant: J. C. Bamford Excavators Limited, Uttoxeter, Staffordshire (GB)

(72) Inventors: Benjamin D. Parker, Uttoxeter (GB); Gary Davies, Uttoxeter (GB); David Burrage, Uttoxeter (GB)

(73) Assignee: J.C. Bamford Excavators Limited, Uttoxeter, Staffordshire (GB)

( * ) Notice: Subject to any disclaimer, the term of this patent is extended or adjusted under 35 U.S.C. 154(b) by 675 days.

(21) Appl. No.: 15/134,247

(22) Filed: Apr. 20, 2016

(65) Prior Publication Data

US 2016/0312433 A1 Oct. 27, 2016

(30) Foreign Application Priority Data

Apr. 21, 2015 (GB) ..... 1506783.8

(51) Int. Cl.

| | |
|---|---|
| ***E02F 3/38*** | (2006.01) |
| ***E02F 3/30*** | (2006.01) |
| ***E02F 3/36*** | (2006.01) |
| ***E02F 3/40*** | (2006.01) |

(Continued)

(52) U.S. Cl.

CPC ..... *E02F 3/3677* (2013.01); *E02F 3/30* (2013.01); *E02F 3/38* (2013.01); *E02F 3/404* (2013.01); *E02F 3/4135* (2013.01); *E02F 3/961* (2013.01)

(58) Field of Classification Search

CPC ..... E02F 3/3677; E02F 3/961; E02F 3/4135; E02F 3/30; E02F 3/38; E02F 3/404

See application file for complete search history.

(56) References Cited

U.S. PATENT DOCUMENTS 6,301,809 B1 * 10/2001 Staggs, Jr. ..... E02F 3/404 37/444
9,255,378 B2 * 2/2016 Sugaya ..... E02F 3/38
2003/0167662 A1 9/2003 Desrochers (Continued)

FOREIGN PATENT DOCUMENTS

CN 203383252 U 1/2014
EP 2 612 971 A2 7/2013

(Continued)

OTHER PUBLICATIONS

Search Report for GB 1506783.8, dated May 18, 2015.

(Continued)

*Primary Examiner* — Lawrence Averick

(74) *Attorney, Agent, or Firm* — Marshall, Gerstein & Borun LLP

(57) ABSTRACT an An arm for a material handling machine includes a first plate, a second plate, and a pair of side walls. The second plate includes two opposite edges and a first of the pair of side walls is welded inward of the first edge of the second plate. A second of the pair of side walls is welded inward of the opposite edge of the second pate to form two flanges, with each of the two flanges extending on opposite sides of the second plate and having at least one hole at each of its ends. Each of the flanges has a length that is longitudinal with respect to the arm and a width that is transverse with respect to the arm and the length of each flange is between ⅓ and ⅙ of the length of the arm.

20 Claims, 7 Drawing Sheets

(51) Int. Cl.
*E02F 3/413* (2006.01)
*E02F 3/96* (2006.01)

(56) References Cited

U.S. PATENT DOCUMENTS

| | | | | |
|---|---|---|---|---|
| 2005/0063774 | A1* | 3/2005 | Fechter | E02F 3/404 403/374.1 |
| 2014/0102243 | A1* | 4/2014 | Shea | E02F 3/404 74/527 |

FOREIGN PATENT DOCUMENTS

| | | | |
|---|---|---|---|
| GB | 1141258 | A | 1/1969 |
| WO | WO-03/053838 | A2 | 7/2003 |

OTHER PUBLICATIONS

Further Search Report for GB 1506783.8, dated Aug. 13, 2015.
Further Search Report for GB 1606878.5, dated Jun. 20, 2016.
Extended European Search for European Patent Application No. 16165595, dated Sep. 29, 2016.

* cited by examiner

ARM FOR MATERIAL HANDLING MACHINE

FIELD OF THE INVENTION

The present invention relates to a method of mounting an attachment on an arm of a material handling machine. The present invention also relates to an arm for a material handling machine.

BACKGROUND OF THE INVENTION

Known material handling machines, such as excavators, have a material handling arm assembly. The arm assembly may have a first arm, known as a boom, pivotally mounted about a generally horizontal axis relative to a chassis of the machine. A second arm, known as a dipper, may be attached to an end of the boom remote from the chassis and may be pivotable about a generally horizontal axis. A material handling implement, such as a bucket, may be pivotally mounted on an end of the dipper. The boom may be raised and lowered by operation of a first hydraulic ram. The dipper may be movable relative to the boom by operation of a second hydraulic ram. The bucket may be movable relative to the dipper by operation of a third hydraulic ram.

It is known to retrofit actuated attachments, for example clamps, known as thumbs, to material handling machines. Such clamps or thumbs may be pivotally mounted adjacent to the bucket on an end of the dipper. The clamp or thumb may be used to grip against the bucket to pick up objects, for example rocks or tree trunks. The clamp or thumb may be movable to lie against the dipper when not in use. The clamp or thumb may be movable relative to the bucket and the dipper by operation of a fourth hydraulic ram. The fourth hydraulic ram may be mounted on the dipper remote from the bucket and the clamp or thumb. The fourth hydraulic ram may be mounted on the dipper via a mount or bracket that is welded to the dipper. In particular the mounted bracket may be welded to a face of the dipper arm, which face may be the furthest point from a neutral axis of the dipper arm. The weld used to weld the mounted brackets onto the dipper arm may therefore be the first weld on that face of the dipper arm.

The fatigue life of dipper arms to which mounted brackets are welded is reduced by a combination of the stress concentration effect of welding and the size and weight of the mount or bracket on the dipper. The highest and lowest points of dippers in such modified material handling machines experience increased stresses, even when the clamp or thumb is not in use, i.e. when the bucket is being used to pick up and move material.

The impact of these effects can be reduced by providing reinforced or heavier dippers, however this increases the amount of material required to construct the material handling machine and results in heavier material handling machines.

SUMMARY OF THE INVENTION

According to a first aspect of the present invention there is provided a method of mounting an attachment on an arm of a material handling machine including the steps of:

(a) providing an arm including a first plate, a second plate and a pair of side walls welded to each of the first plate and the second plate, the arm having a connector for pivotable mounting of the attachment at a first end of the arm and a connector for pivotable mounting to a further component of the material handling machine at a second end of the arm opposite to the first end; and wherein the second plate has two opposite edges and a first of the pair of side walls is welded inward of one edge and a second of the pair of side walls is welded inward of the other edge to form two flanges, each of the two flanges extending on opposite sides of the second plate and each of the two flanges having at least one hole at each of its ends;

(b) providing a bracket including a mounting plate having a pair of lugs for supporting an actuator for the attachment; the pair of lugs being positioned in a central portion of the mounting plate; and the mounting plate having at least one hole adjacent to each of its corners;

(c) aligning the holes of the mounting plate with the holes on each of the pair of flanges;

(d) securing the bracket on the arm by securing the mounting plate to each of the pair of the flanges by passing a fastener through each hole of the mounting plate and the corresponding hole on each of the pair of flanges;

(e) mounting the actuator for the attachment on the pair of lugs;

(f) mounting the attachment on the connector at the first end of the arm; and (g) connecting the actuator to the attachment.

Securing the bracket for mounting the actuator for the attachment on the arm to flanges on the arm using fasteners that are passed through holes in the bracket and corresponding holes in the flanges eliminates the stress concentration effect of welding and ensures any stresses caused by the weight of the bracket and the mounted actuator and thumb are distributed across the flanges, thereby removing the need for a reinforced dipper arm.

The first plate may have two opposite edges. One of the pair of side walls may be welded inward of the first edge of the first plate and the other of the pair of side walls may be welded inward of the opposite edge of the first plate.

The second plate may have a first face that faces the first plate and the pair of side walls may be welded to the first face.

Each of the two flanges may have a length that is approximately one third to one sixth of the length of the arm, preferably one quarter to one fifth of the length of the arm.

Each of the two flanges may have a length that is in the range 0.05 m to 2.00 m, preferably 0.15 m to 0.50 m. Each of the two flanges may extend in a direction that is parallel to the other of the two flanges.

The ratio of the width of each of the flanges to the length of each of the flanges may be 1:3 to 1:5.

Each of the two flanges may have an outer edge and the outer edges of the flanges may be substantially parallel to each other.

The length of the flanges is selected to advantageously distribute the mounted bracket, actuator and thumb without significantly increasing the weight of the arm.

Each of the flanges may be positioned toward the connector for pivotable mounting to a further component of the material handling machine.

Each flange may have two lugs, the two lugs being spaced apart and defining each of the ends of the flange. The lugs may comprise the at least one hole at each end of the flange.

A bucket may be pivotably mounted at the first end of the arm. The bucket may be movable in a crowd direction or a dump direction relative to the arm and the open face of the bucket may generally face the bracket.

Each of the flanges may have a width that is in the range 20 mm to 70 mm, preferably 25 mm to 35 mm.

Each of the two flanges may have two holes at each of its ends and each corner of the mounting plate may have two holes.

Each of the two holes in each of the two flanges may be arranged along the length of the respective flange and each of the two holes in each of the corners of the mounting plate are arranged along the length of the mounting plate.

The distance between the at least one hole at each end of each of the flanges and a weld line between the second plate and the side wall to which the second plate is welded may be at least 5 mm, preferably at least 10 mm.

The mounting plate may have a thickness in the range 5 mm to 30 mm.

The second plate may have a thickness and the ratio of the mounting plate thickness to the second plate thickness may be approximately 4:1 to 2:1.

Each of the pair of lugs may have a foot that extends in a direction parallel to the length of the mounting plate.

Each of the pair of lugs may have a generally annular body having an aperture.

The aperture of each of the pair of lugs may be offset relative to the center of the foot of the respective lug.

The fasteners that are passed through each hole of the mounting plate and the corresponding hole on each of the pair of flanges may be one or more of a threaded fastener or a bolt or a rivet.

The attachment may be a thumb.

The arm may have a length. The connector for pivotable mounting of the attachment at a first end of the arm may have a first pivot axis. The connector for pivotable mounting to a further component of the material handling machine at a second end of the arm may have a second pivot axis. The distance between the first pivot axis and the second pivot axis may be substantially equal to the length of the arm.

According to a second aspect of the present invention there is provided an arm for a material handling machine including: a first plate; a second plate; a pair of side walls welded to each of the first plate and the second plate; the second plate including two flanges, each of the two flanges extending on opposite sides of the second plate and having at least one hole at each of its ends; and wherein each of the flanges has a length that is longitudinal with respect to the arm and a width that is transverse with respect to the arm and the length of each flange is between ⅓ and ⅙ of the length of the arm, wherein the second plate has two opposite edges and a first of the pair of side walls is welded inward of the first edge of the second plate and a second of the pair of side walls is welded inward of the opposite edge of the second plate to form the two flanges on the second plate.

The length of each flange may be between ¼ and ⅕ of the length of the arm.

The first plate may have two opposite edges and one of the pair of side walls may be welded inward of the first edge of the first plate and/or the other of the pair of side walls may be welded inward of the opposite edge of the first plate.

The second plate may have a first face that faces the first plate and the pair of side walls may be welded to the first face.

Each of the two flanges may have two holes at each of its ends.

The two holes at each end of each of the two flanges may be arranged longitudinally with respect to the respective flange.

The distance between the at least one hole at each end of each of the flanges may be up to approximately 1.95 m, preferably in the range of approximately 0.10 m to 0.45 m.

The at least one hole at each end of each of the flanges may be separated by a distance of approximately 20 mm to 70 mm, preferably approximately 25 mm to 35 mm.

The distance between the at least one hole at each end of the flange and a weld line between the second plate and the side wall to which the second plate is welded may be at least 5 mm, preferably at least 10 mm.

The arm may have a first end for pivotable mounting of an implement and a second end for pivotable mounting to a further component of the material handling machine and/or each of the flanges may be positioned toward the second end of the arm.

A bucket may be pivotably mounted at the first end of the arm. The bucket may be movable in a crowd direction or a dump direction relative to the arm and the open face of the bucket may generally face the two flanges.

Each of the two flanges may have a width in the range 20 mm to 70 mm, preferably 25 mm to 35 mm.

According to a third aspect of the present invention there is provided a material handling machine including a chassis having a ground engaging propulsion structure;

a loading arm assembly pivotably mounted via a substantially horizontal axis to the machine; the loading arm assembly including an arm according to the second aspect of the present invention.

The material handling machine may further comprise a body having a vertical axis, wherein the arm is mounted on the body.

The ground engaging propulsion structure may include a pair of wheels or a continuous loop track at either side of the body.

The arm assembly may include a boom and the arm may be pivotably mounted with respect to the boom.

BRIEF DESCRIPTION OF THE DRAWINGS

The invention will now be described, by way of example only, with reference to the accompanying drawings in which.

DETAILED DESCRIPTION

Figure 1:
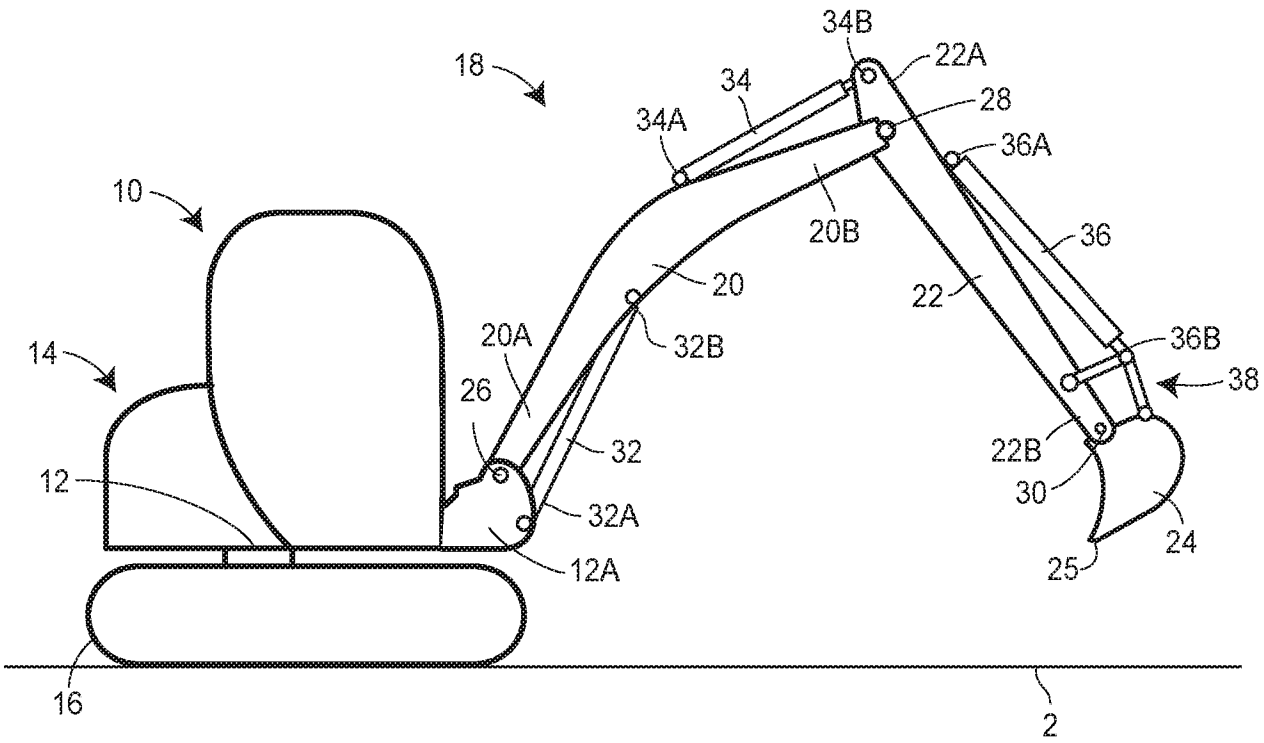
FIG. 1 is a schematic side view of a material handling machine for use in a method according to the present invention.
Figure 2:
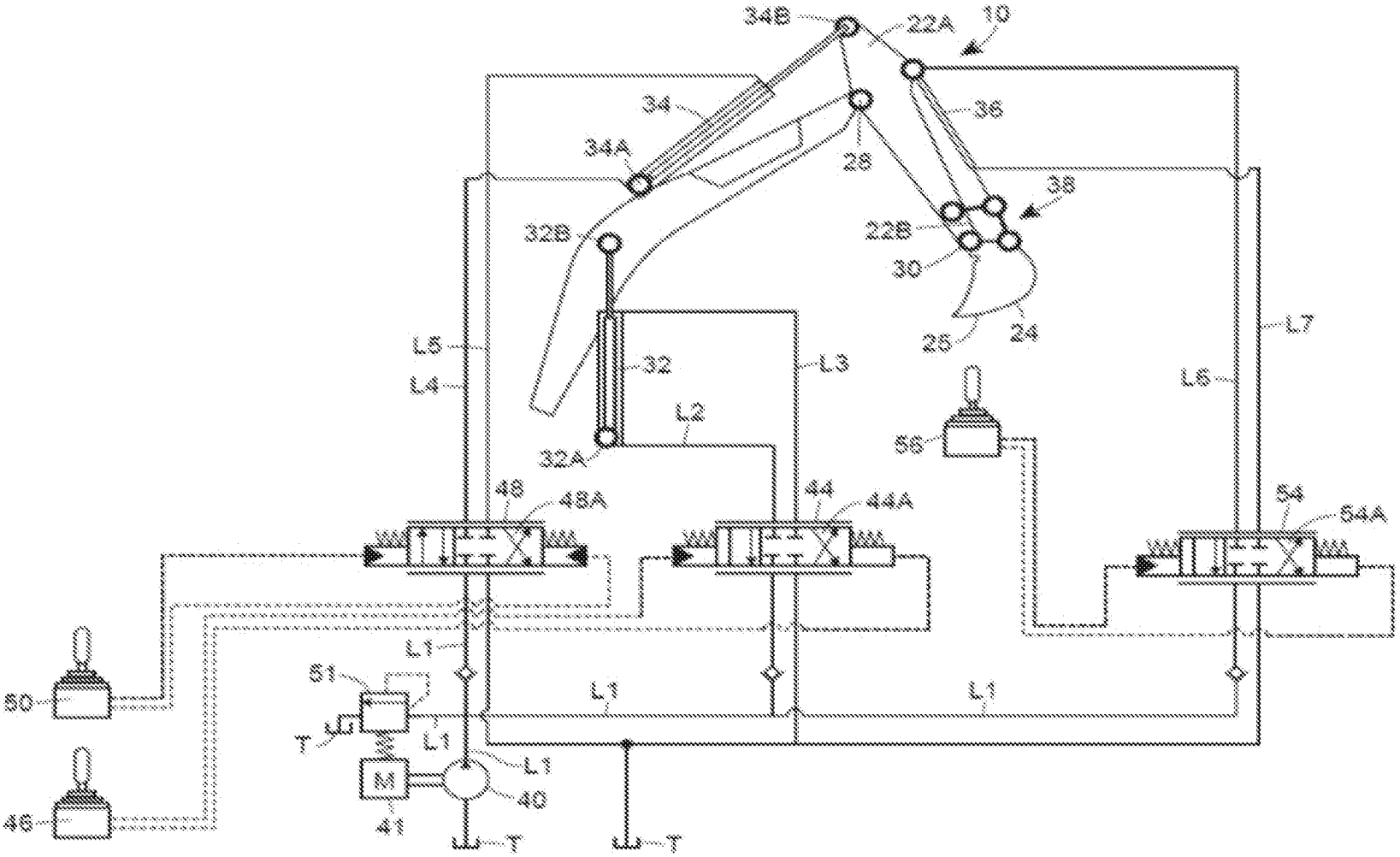
FIG. 2 is a schematic view of part of the material handling machine of FIG. 1.

With reference to FIGS. 1 and 2, there is shown a material handling machine 10, which in this example is an excavator, including a chassis 12 and an operator cab 14. The operator cab 14 is mounted on the chassis 12. Ground engaging transport means in the form of a pair of tracks 16 are provided to move the machine 10 over the ground 2.

Attached to the chassis 12 is an arm assembly 18 (also known as an implement support system). The arm assembly 18 includes a first arm in the form of a boom 20, a second arm in the form of a dipper 22 and a ground engaging implement in the form of a bucket 24. The bucket 24 has bucket teeth 25. The boom 20 is pivotally mounted by pivot 26 to link 12A at a first end 20A of the boom 20. Link 12A is pivotally mounted at a generally vertical axis relative to the chassis 12. Pivot 26 is orientated horizontally. The dipper 22 is pivotally mounted via pivot 28 to a second end 20B of the boom 20. Pivot 28 is orientated horizontally and has an axis A. The bucket 24 is pivotally mounted via pivot 30 to an end 22B of dipper 22 remote from end 22A of dipper 22. Pivot 30 is orientated horizontally and has an axis B. Axis A of pivot 28 and axis B of pivot 30 are separated by a distance C, as shown in FIG. 3.

Figure 3:
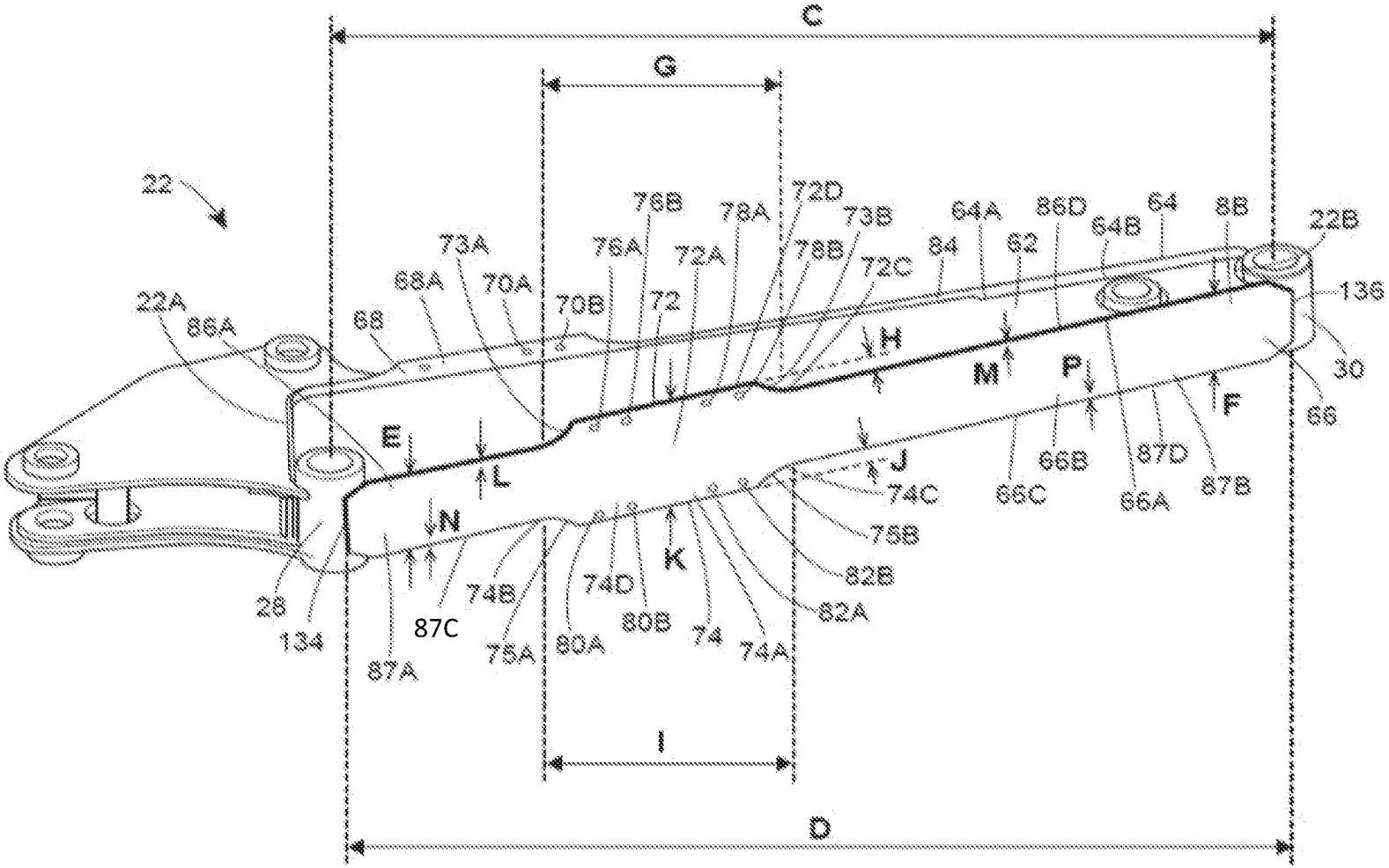
FIG. 3 is a perspective view of the dipper of FIG. 1.

With reference to FIG. 3, the dipper 22 includes a box-section comprising two side walls (only one of which, 62, is shown in FIG. 3), a first plate 64 and a second plate 66. As shown, the dipper 22 tapers towards the end 22B, but the dipper 22 could be of constant width. The first plate 64 has two opposing surfaces or faces (only one of which, 64B, is shown in FIG. 3). As shown in FIG. 3, surface or face 64B of the first plate 64 faces towards the second plate 66.

The first plate 64 includes a flange 68, which is positioned toward end 22A of the dipper 22 and which extends outwards from the width of the first plate 64 (i.e. the flange 68 is integral with the first plate 64). The flange 68 and the first plate 64 are made from a single sheet of metal (i.e. the flange 68 and the first plate 64 are unitary components).

The flange 68 has two opposing surfaces (only one of which, 68A, is shown in FIG. 3). The surface 68A of the flange 68 is substantially flush with the surface or face 64B of the first plate 64. The flange 68 includes a pair of holes 70A, 70B which extend through the two opposing surfaces in the flange 68. The first plate 64 may include a second flange (not shown) on the side opposite to flange 68.

The second plate 66 has two opposing surfaces or faces (only one of which, 66B, is shown in FIG. 3). As shown in FIG. 3, surface or face 66B of the second plate 66 faces away from the first plate 64. The second plate 66 has a first end 134 adjacent to pivot 28 and a second end 136 adjacent to pivot 30. The second plate 66 has a length D that corresponds to the distance between the first end 134 and the second end 136 of the second plate 66. The length D of the second plate 66 is substantially the same as the distance C between pivot axis A and pivot axis B.

The second plate 66 has a first outer edge 66A that extends between the first end 134 and the second end 136 of the second plate 66 and a second outer edge 66C that extends between the first end 134 and the second end 136 of the second plate 66.

The first outer edge 66A is opposite to the second outer edge 66C. The first outer edge 66A and the second outer edge 66C are separated by a distance E proximal to the first end 134 of the second plate 66. The distance E corresponds to the width of the second plate 66 adjacent to the first end 134 of the second plate 66.

The first outer edge 66A and the second outer edge 66C are separated by a distance F proximal to the second end 136 of the second plate 66. The distance F corresponds to the width of the second plate 66 adjacent to the second end 136 of the second plate 66.

As shown in FIG. 3, the distance E is substantially the same as the distance F, i.e. the width of the second plate 66 at the first end 134 is substantially the same as the width of the second plate 66 at the second end 136 of the second plate 66. It will be understood that the distance E may be greater than the distance F i.e. the width E of the second plate 66 at the first end 134 may be greater than the width F of the second plate 66 at the second end 136, for example if the second end 136 of the second plate 66 tapers from the first end 134 of the second plate 66.

A first portion 73A of the first outer edge 66A of the second plate 66 that is positioned toward the first end 134 of the second plate 66 extends or curves outward from the width E of the second plate 66 and a second portion 73B of the first outer edge 66A extends or curves inward toward the second end 136 of the second plate 66 to form a first flange 72 that is integral with the second plate 66 and that extends between the first end 134 and the second end 136 of the second plate 66.

The first flange 72 has a first end 72B positioned toward the first end 134 of the second plate 66 and a second end 72C positioned toward the second end 136 of the second plate 66. The first end 72B and the second end 72C of the first flange 72 are separated by a distance G. The distance G corresponds to the length of the first flange 72, which is approximately one quarter to one fifth of the length D of the second plate 66. The first flange 72 has an outer edge 72D.

In a similar way, a first portion 75A of the second outer edge 66C of the second plate 66 that is positioned toward the first end 134 of the second plate 66 extends or curves outward from the width E of the second plate 66 and a second portion 75B of the second outer edge 66C extends or curves inward toward the second end 136 of the second plate 66 to form a second flange 74 that is integral with the second plate 66 and that extends between the first end 134 and the second end 136 of the second plate 66.

The second flange 74 has a first end 74B positioned toward the first end 134 of the second plate 66 and a second end 74C positioned toward the second end 136 of the second plate 66. The first end 74B and the second end 74C of the second flange 74 are separated by a distance I. The distance I corresponds to the length of the second flange 74, which is approximately one quarter to one fifth of the length D of the second plate 66. The length I of the second flange 74 is substantially the same as the length G of the first flange 72. The second flange 74 has an outer edge 74D.

The first flange 72 is positioned opposite the second flange 74 on the second plate 66 such that the width K of the portion of the second plate 66 having the first and second flanges 72, 74 is equal to the sum of the widths E, H and J. The outer edge 72D of the first flange 72 is substantially parallel to the outer edge 74D of the second flange.

The second plate 66 is made from a single sheet of metal (i.e. the first and second flanges 72, 74 and the second plate 66 are unitary components).

The first flange 72 has two opposing surfaces (only one of which, 72A is shown in FIG. 3) and includes a first pair of holes 76A, 76B adjacent to its first end 72B and a second pair of holes 78A, 78B adjacent to its second end 72C. Each of the holes 76A, 76B, 78A, 78B extends through the two opposing surfaces of the first flange 72. Surface 72A of the first flange 72 is substantially flush with the surface 66B of the second plate 66.

Similarly, the second flange 74 has two opposing surfaces (only one of which, 74A, is shown in FIG. 3) and includes a first pair of holes 80A, 80B adjacent to its first end 74B and a second pair of holes 82A, 82B adjacent to its second end 74C. Each of the holes 80A, 80B, 82A, 82B extends through the two opposing surfaces of the second flange 74. Surface 74A of the second flange 74 is substantially flush with the surface 66B of the second plate 66.

To form the box-section, the side wall 62 is welded inward of an edge 64A of the first plate 64 on the surface or face 64B such that a lip 84 is formed adjacent to the edge 64A of the first plate 64. The side wall 62 is similarly welded inward of the first outer edge 66A of the second plate 66 on the surface opposite to surface 66B (i.e. the surface that faces the first plate 64) such that a first lip 86A is formed between the first end 134 of the second plate 66 and the first end 72B of the first flange 72 and a second lip 86B is formed between the second end 72C of the first flange 72 and the second end 136 of the second plate 66. The second side wall (not shown) is welded in a similar way inward of an edge (not shown) of the first plate 64 (on the surface or face 64B) and inward of the second outer edge 66C of the second plate 66 (on the surface opposite to surface 66B) such that a first lip 87A is formed between the first end 134 of the second plate 66 and the first end 74B of the second flange 74 and a second lip 87B is formed between the second end 74C of the second flange 74 and the second end 136 of the second plate 66.

The first lip 86A has an outer edge 86C and an inner edge (not shown) that is located at the weld line between the side wall 62 and the second plate 66 toward the first end 134 of the second plate 66. The width L of the first lip 86A is defined by the distance between the outer edge 86C and the inner edge (not shown) of the first lip 86A.

The second lip 86B has an outer edge 86D and an inner edge (not shown) that is located at the weld line between the side wall 62 and the second plate 66 toward the second end 136 of the second plate 66. The width M of the second lip 86B is defined by the distance between the outer edge 86D and the inner edge (not shown) of the second lip 86B. The width M of the second lip 86B is substantially equal to the width L of the first lip 86A.

The width H of the first flange 72 is defined by the distance the outer edge 72D of the first flange 72 extends outward from the second plate 66 relative to the inner edge (not shown) of the first lip 86A or the second lip 86B. The width H of the first flange 72 is greater than the width L of the first lip 86A or the width M of the second lip 86B.

The third lip 87A has an outer edge 87C and an inner edge (not shown) that is located at the weld line between the side wall (not shown) and the second plate 66 toward the first end 134 of the second plate 66. The width N of the third lip 87A is defined by the distance between the outer edge 87C and the inner edge (not shown) of the first lip 87A.

The fourth lip 87B has an outer edge 87D and an inner edge (not shown) that is located at the weld line between the side wall (not shown) and the second plate 66 toward the second end 136 of the second plate 66. The width P of the fourth lip 87B is defined by the distance between the outer edge 87D and the inner edge (not shown) of the second lip 87B. The width P of the fourth lip 87B is substantially equal to the width N of the third lip 87A.

The width J of the second flange 74 is defined by the distance the outer edge 74D of the second flange 74 extends outward from the second plate 66 relative to the inner edge (not shown) of the third lip 87A or the fourth lip 87B. The width J of the second flange 74 is greater than the width N of the third lip 87A or the width P of the fourth lip 87B.

The side walls 62 are thus welded inward of the edges of the first plate 64 and second plate 66 so that the side walls 62 are inset from the edges of the first plate 64 and the second plate 66. The lips 84, 86A, 86B, 87A, 87B are wide or thick enough to allow for welding of the side plates to the first plate 64 and/or the second plate 66. The thickness or width of the lips 84, 86A, 86B, 87A, 87B is less than the width H of the first flange 72 and the width J of the second flange 74, both of which are thick or wide enough to accommodate bolts in addition to weld lines. The lips 84, 86A, 86B, 87A, 87B, the first flange 72 and the second flange 74 are integral with the second plate 66. The weld lines extend along inner surfaces of the first plate 64 and the second plate 66, which experience compression forces during operation of the dipper 22 (when the outer surfaces of the first plate 64 and the second plate 66 experience tension forces).

Figure 4:
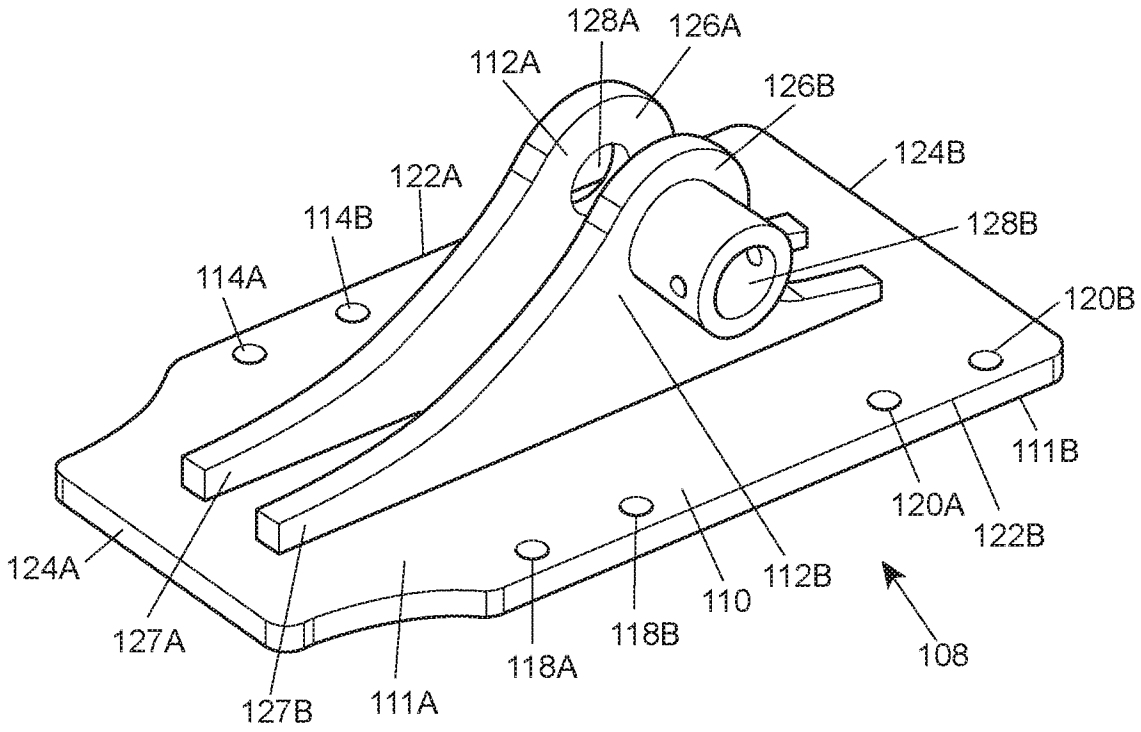
FIG. 4 is a perspective view of a ram bracket for mounting an actuated attachment on a dipper.

With reference now to FIG. 4, there is shown a bracket 108 for mounting an actuated attachment on the dipper 22.

The bracket 108 includes a mounting plate 110 and a pair of lugs 112A, 112B.

The mounting plate 110 is rectangular in shape has two opposing surfaces 111A, 111B and has side edges 122A, 122B and ends 124A, 124B. At the corner of edge 122A and end 124A there is a first pair of holes 114A, 114B. At the corner of edge 122A and end 124B there is a second pair of holes 116A, 116B (shown in FIG. 5). At the corner of edge 122B and end 124A there is a third pair of holes 118A, 118B. At the corner of edge 122B and end 124B there is a fourth pair of holes 120A, 120B. Each of the first, second, third and fourth pair of holes 114A, 114B, 116A, 116B, 118A, 118B, 120A, 120B extends through the two opposing surfaces 111A, 111B. The width of the mounting plate 110 from edge 122A to edge 122B corresponds to the combined width of the second plate 66 and the flanges 72 and 74. The length of the mounting plate 110 from end 124A to 124B corresponds to the length of flanges 72 and 74.

The lug 112A has a generally circular body 126A and an elongate foot 127A. The generally circular body 126A is offset relative to the center of the elongate foot 127A and includes an aperture 128A. The lug 112B is the same shape as lug 112A and has generally circular body 126B and an elongate foot 127B. The generally circular body 126B is offset relative to the center of the elongate foot 127B and includes an aperture 128B.

Lug 112A is welded on the mounting plate 110 such that the elongate foot 127A is positioned inward of edge 122A, the length of the elongate foot 127A extends in a direction parallel to the edge 122A and the generally circular body 126A extends away from surface 111A. Lug 112B is welded on the plate 100 such that the elongate foot 127B is positioned inward of edge 122B, the length of the elongate foot 127B extends in a direction parallel to the edge 122B and the generally circular body 126B extends away from surface 111A.

Figure 5:
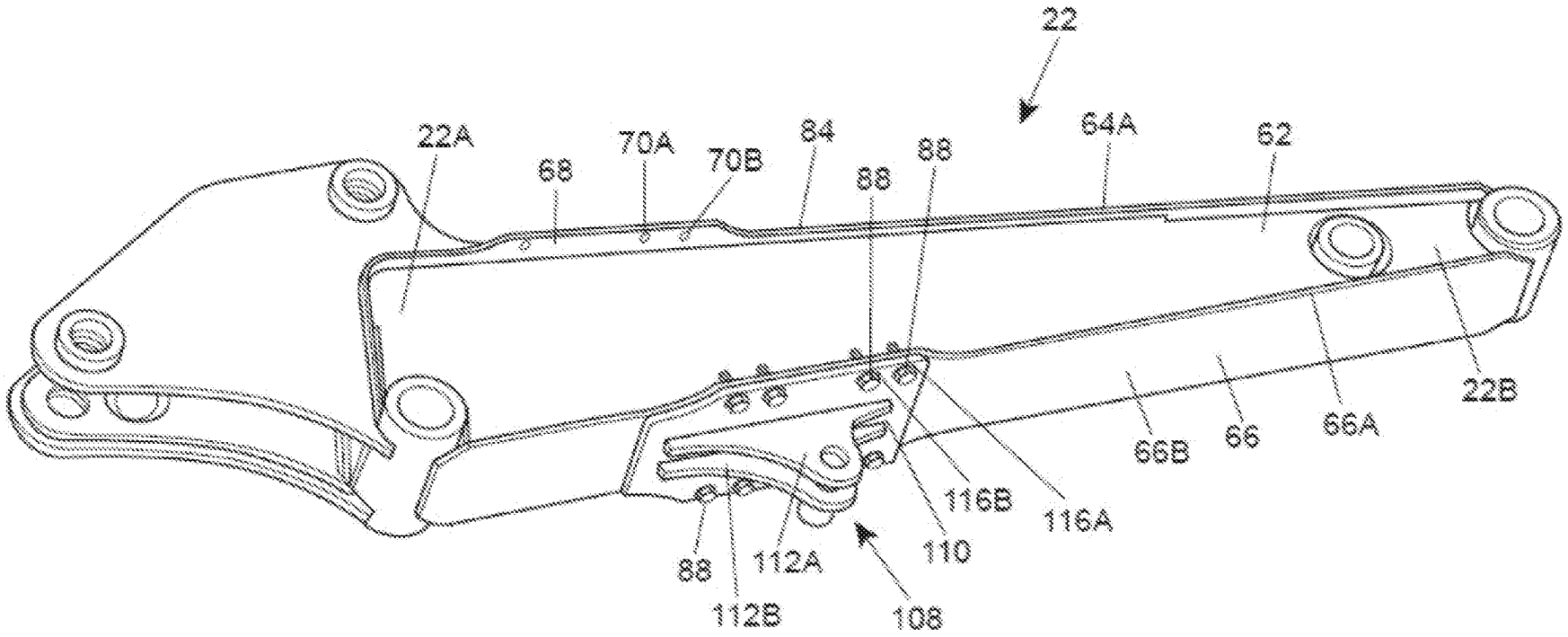
FIG. 5 is a perspective view of the ram bracket of FIG. 4 mounted on a dipper.

A method of mounting a thumb 100 on the dipper 22 will now be described with particular reference to FIGS. 5 and 6.

The holes 114A, 114B and 116A, 116B of the mounting plate 110 are aligned with holes 76A, 76B and 78A, 78B, respectively on flange 72. In this configuration, surface 111B of the mounting plate 110 is adjacent to surface 72A of flange 72. Holes 118A, 118B and 120A, 120B of the mounting plate 110 are aligned with holes 80A, 80B and 82A, 82B, respectively on flange 74. In this configuration, surface 111B of the mounting plate 110 is adjacent to surface 74A of flange 74. A fastener 88 is passed through each of the holes in order to bring surface 111B of the mounting plate 110 into engagement with surfaces 72A, 74A of the flanges 72, 74 and secure the mounting plate 110 to the flanges 72, 74. The fourth hydraulic ram 106 is mounted by passing a pin 90 through the apertures 128A, 128B on the lugs 112A, 112B of the bracket 108 and a connector (not shown) on the fourth hydraulic ram 106. The thumb 100 is mounted on the dipper 22 by pivot 130. The second end 106B of the fourth hydraulic ram 106 opposite to the end 106A that is mounted on the lugs 112A, 112B is then mounted on the connector 104 of the thumb 100.

Referring again to FIGS. 1 and 2, a first hydraulic actuator in the form of a first hydraulic ram 32 has a first end 32A pivotally attached to the chassis 12 and a second end 32B pivotally attached to the boom 20 part way between the first 20A and second 20B ends of the boom 20. A second hydraulic actuator in the form of a second hydraulic ram 34 has a first end 34A pivotally attached to the boom 20 part way between the first 20A and second 20B ends of the boom 20 and a second end 34B pivotally attached to the dipper 22 proximate the first end 22A of the dipper 22. A third hydraulic actuator in the form of a third hydraulic ram 36 has a first end 36A pivotally attached to the dipper 22 proximate the first end 22A of the dipper 22 and a second end 36B pivotally attached to a linkage mechanism 38 proximate the second end 22B of the dipper 22. The linkage mechanism 38 per se is known and simply converts extension and retraction movement of the third hydraulic ram 36 into rotary movement of the bucket 24 about pivot 30.

Extension of the first hydraulic ram 32 causes the boom 20 to rise, and contraction of the first hydraulic ram 32 causes lowering of the boom 20. Extension of the second ram 34 causes the dipper 22 to pivot in a clockwise direction (when viewing FIG. 1) about pivot 28, i.e. the boom 20 is caused to move in a "dipper in" direction, and retraction of the second hydraulic ram 34 causes the dipper 22 to move in an anti-clockwise direction (when viewing FIG. 1) about pivot 28, i.e. the boom 20 is caused to move in a "dipper out" direction. Extension of the third hydraulic ram 36 causes the bucket 24 to move in a clockwise direction about pivot 30, i.e. in a "crowd" direction, and retraction of the third hydraulic ram 36 causes the bucket to move in an anti-clockwise direction about pivot 30, i.e. in a "dump" direction.

The first 32, second 34 and third 36 hydraulic rams are all double acting hydraulic rams. Double acting hydraulic rams are known per se. They include a piston within a cylinder. The piston is attached to a rod which extends beyond the end of the cylinder. The end of the rod remote from the piston defines one end of the hydraulic ram. The end of the cylinder remote from the rod defines an opposite end of the hydraulic ram. A "head side chamber" is defined between the piston and the end of the cylinder remote from the head. A "rod side chamber" is defined between the piston and the end of the cylinder proximate the end of the rod. Pressurization of the head side pressure chamber extends the ram and pressurization of the rod side chamber causes the ram to retract.

The machine 10 includes a system for operating the first 32, second 34 and third 36 hydraulic rams, as described below and with reference to FIG. 2.

A hydraulic pump 40 is driven by a prime mover 41. Prime mover 41 may be an internal combustion engine, though other prime movers are suitable. A boom spool valve 44 can be operated by an operator manipulating boom control 46. In this case boom control 46 is a joystick. A dipper spool valve 48 can be controlled via a dipper control 50. In this case dipper control 50 is a joystick. An implement spool valve 54 can be operated by an operator manipulating implement control 56. In this case implement control 56 is a joystick. Joysticks 46, 50 and 56 may be separate joysticks (as shown in FIG. 2). Alternatively, two of the boom control 46, dipper control 50 and implement control 56 may be combined in a single joystick. Alternatively, all three of the boom control 46, dipper control 50 and implement control 56 may be combined in a single joystick. Controls other than joysticks may be used to control one or more of the boom spool, dipper spool and implement spool.

Operation of a material handling machine is as follows:

The prime mover 41 drives the hydraulic pump 40 which takes hydraulic fluid from tank T and pressurizes hydraulic line L1. As shown in FIG. 2, the dipper spool valve 48 is closed, the implement spool valve 54 is closed, the boom spool valve 44 is closed and hence pressurized fluid in line L1 will pass through the relief valve 51 back to tank T.

If it is desired to raise the boom 20, the boom control 46 is operated such that the boom spool 44A of the boom spool valve 44 is moved so as to connect hydraulic line L1 and hydraulic line L2. This causes hydraulic fluid to pass into the head side pressure chamber of the first hydraulic ram 32 thereby extending the first hydraulic ram 32 and raising the boom 20. Hydraulic fluid from the rod side chamber passes into hydraulic line L3 and back to tank T via the boom spool valve 44. In order to lower the boom 20, the boom control 46 is operated to move the boom spool 44A in the opposite direction thereby connecting hydraulic line L1 with hydraulic line L3 and hydraulic line L2 with tank T.

In order to move the dipper 22 in a "dipper in" direction the dipper control 50 is operated such that the dipper spool 48A of the dipper spool valve 48 connects hydraulic line L1 with hydraulic line L4. Hydraulic line L4 is connected to the head side of the second hydraulic ram 34 which causes the ram to extend thereby pivoting the dipper arm 22 in a clockwise direction about pivot 28. Hydraulic fluid in the rod side of second hydraulic ram 34 passes into hydraulic line L5 and then on through the dipper spool valve 48 to tank T. In order to move the dipper in a "dipper out" direction, the dipper control 50 is operated such that the dipper spool 48A connects hydraulic line L1 with hydraulic line L5 and connects hydraulic line L4 with tank T. This results in retraction of the second hydraulic ram 34 thereby causing the dipper 22 to move in an anti-clockwise direction above pivot 28.

In order to move the bucket 24 in a "crowd" direction, the implement control 56 is operated such that the implement spool 54A of the implement spool valve 54 connects hydraulic line L1 with hydraulic line L6. Hydraulic line L6 is connected to the head side of the third hydraulic ram 36 which causes the ram to extend thereby pivoting the bucket 24 in a clockwise direction about pivot 30. Hydraulic fluid in the rod side of third hydraulic ram 36 passes into hydraulic line L7 and then on through the implement spool valve 54 to tank T. In order to move the bucket 24 in a "dump" direction the implement control 56 is operated such that the implement spool 54A connects hydraulic line L1 with hydraulic line L7 and connects hydraulic line L6 to the tank T. This results in retraction of the third hydraulic ram 36 thereby causing the bucket 24 to move in an anti-clockwise direction about pivot 30.

When digging a trench or the like a typical sequence of movements of the arm assembly 18 is as follows:

Firstly, the boom 20 is lowered and the dipper 22 is moved in a "dipper out" direction thereby moving the bucket teeth 25 of the bucket 24 away from the chassis 12. The boom 20 is then further lowered such that the bucket teeth 25 engage the ground 2. The bucket 24 is then crowded slightly so as to start to move the bucket teeth 25 through the ground 2. The dipper control 50, boom control 46 and implement control 56 are then simultaneously operated to progressively move the dipper 22 in the "dipper in" direction, to move the boom 20 in a "boom raised" direction and to move the bucket 24 in a "crowd" direction such that the bucket teeth 25 move generally towards the chassis 12. As will be appreciated, skill is involved in simultaneously manipulating the dipper control 50, the boom control 46 and the implement control 56 to efficiently fill the bucket 24 with material. Once the bucket 24 is full, the boom 20 is raised, the arm assembly 18 is swung laterally relative to the machine 10 and the material is then dumped by moving the bucket 24 to the "dump" position. The sequence is then repeated.

Figure 6:
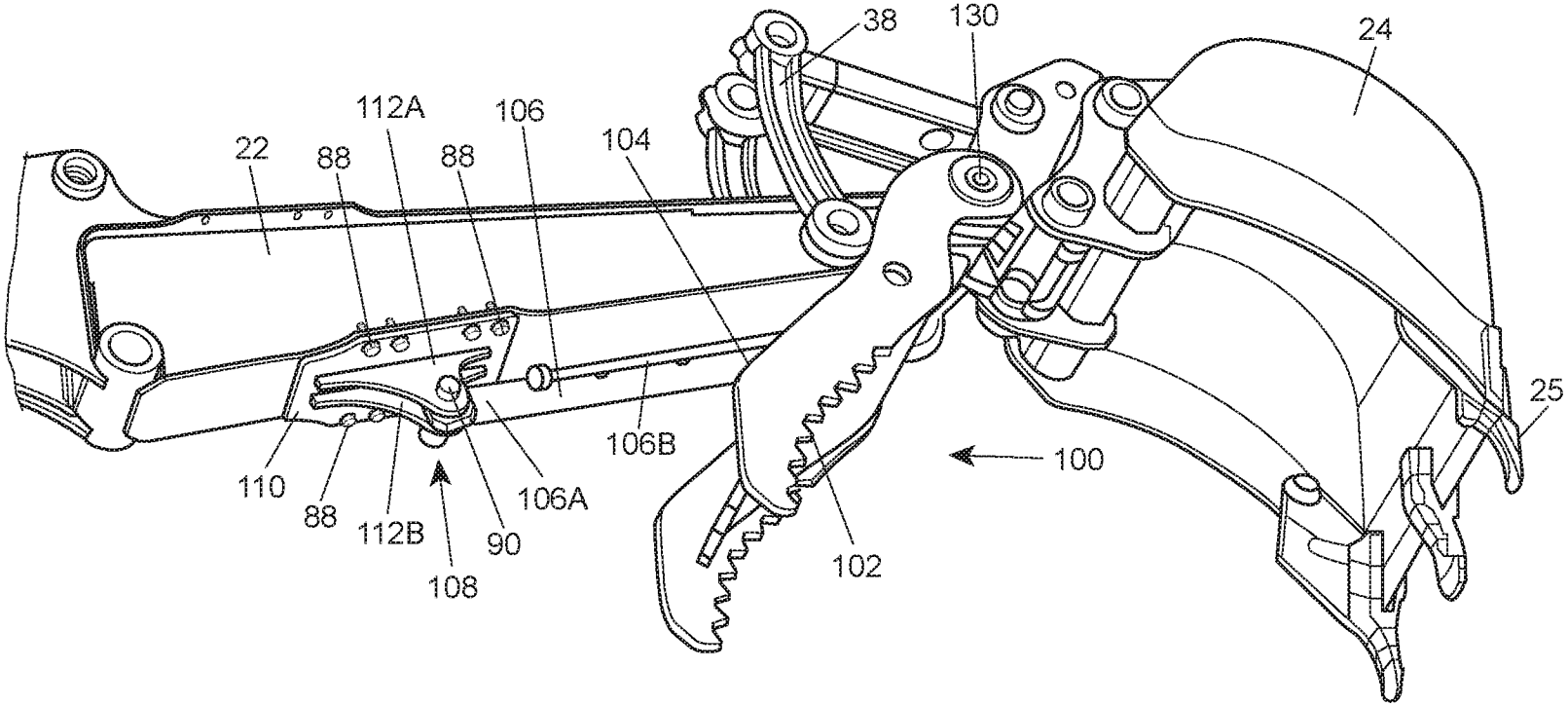
FIG. 6 is a side view of a dipper to which a thumb has been mounted in accordance with the method of the present invention.

Referring now to FIG. 6, a thumb 100 and a bucket 24 are pivotally mounted via an extended pivot 130 to the second end 22B of dipper 22. Pivot 130 is orientated horizontally.

The thumb 100 includes teeth 102 at an end 100B opposite to the end 100A at which it is pivotally mounted to the second end 22B of dipper 22. The thumb 100 also includes a connector 104 positioned on a side of the thumb 100 opposite to the teeth 102.

A fourth hydraulic actuator in the form of a fourth hydraulic ram 106 has a first end 106A attached to a bracket 108 and a second end 106B at which the fourth hydraulic ram 106 is connected to the connector 104 on the thumb 100.

Extension of the fourth hydraulic ram 106 causes the thumb 100 to move in an anti-clockwise direction about pivot 130, i.e. towards the bucket 24, and retraction of the fourth hydraulic ram 106 causes the thumb 100 to move in a clockwise direction about pivot 130, i.e. away from the bucket 24.

The fourth hydraulic ram 106 is a double acting hydraulic rams and is operated in the same way as described for the first, second and third hydraulic rams.

Operation of the material handling machine with the thumb is as follows:

A thumb spool valve (not shown) can be operated by an operator manipulating thumb control (not shown), for example a joystick in order to control movement of the thumb 100.

In order to move the thumb 100 towards the bucket 24, the thumb control (not shown) is operated such that the thumb spool of the thumb spool valve (not shown) connect a hydraulic line L1 with a first hydraulic line (not shown) that is connected to the head side of the fourth hydraulic ram 106, which causes the ram 106 to extend thereby pivoting the thumb 100 in an anti-clockwise direction about pivot 130. Hydraulic fluid in the rod side of the fourth hydraulic ram 106 passes into a further hydraulic line (not shown) and then on through the thumb spool (not shown) valve (not shown) to tank T. In order to move the thumb 100 away from the bucket 24, the thumb control (not shown) is operated such that the thumb spool connects hydraulic line L1 with the further hydraulic line (not shown) and connects the first hydraulic line to the tank T. This results in retraction of the fourth hydraulic ram 106 thereby causing the thumb 100 to move in a clockwise direction about pivot 130.

When picking up a rock or tree trunk or the like, a typical sequence of movements of the arm assembly 18 is as follows:

Firstly, the boom 20 is lowered and the dipper 22 is moved in a "dipper out" direction thereby moving the bucket teeth 25 of the bucket away from the chassis 12. The boom 20 is then further lowered such that the bucket teeth 25 are positioned adjacent to the item to be picked up. The bucket 24 is then crowded slightly so as to start to move the bucket teeth 25 towards the rock or tree trunk. The thumb control is then operated to move the thumb 100 in towards the bucket 24 in order to grip the rock or tree trunk between the thumb 100 and the bucket teeth 25. Once the rock or tree trunk are gripped between the bucket 24 and the thumb 100, the boom 20 is raised, the arm assembly 18 is swung laterally relative to the machine 10 and the rock or tree trunk is then deposited in the required location by moving the thumb 100 away from the bucket 24. The sequence is then repeated as necessary to collect and move multiple rocks or tree trunks.

Figure 7:
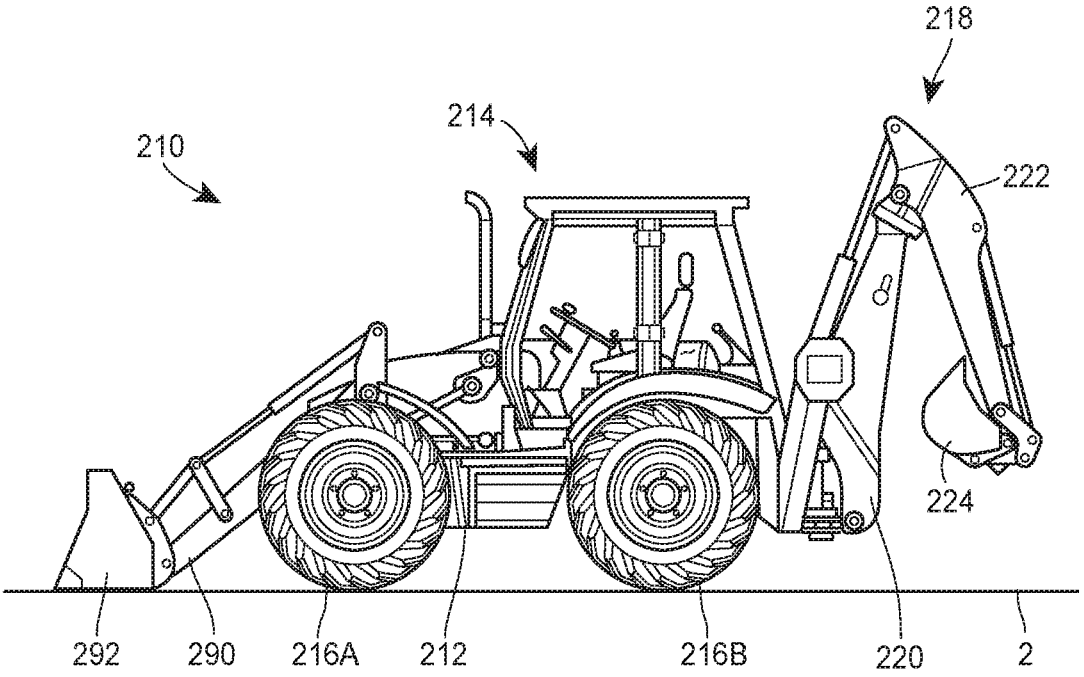
FIG. 7 is a schematic view of part of an alternative material handling machine for use in a method according to the present invention.

With reference to FIG. 7 there is shown a material handling machine 210 including a chassis 212 and an operator cab 214. Ground engaging transport means in the form of a pair of wheels 216A, 216B of each side of the machine are provided to move the machine 210 over the ground 2. Attached to the chassis 212 is an arm assembly 218 which includes a first arm in the form of a boom 220, a second arm in the form of a dipper 222 and a ground engaging implement in the form of a bucket 224. Machine 210 also includes a front loader arm 290 which includes a shovel 292.

As will be appreciated the machine 210 is a back hoe loader. Operation of the arm assembly 218 (known as the back hoe) is similar to the operation of the arm assembly 18 of the machine 10. Operation of the front loader arm 290 and shovel 292 is well known in the art, but in summary hydraulic rams are able to lift and lower the front loader arm 290 and further hydraulic rams are able to "crowd" or "dump" shovel 292 relative to the front loader arm 290.

As described above, the thumb 100 is mounted on the dipper 22 of the machine 10. The thumb 100 may also be mounted on the dipper 222 of the machine 210.

As mentioned above, the machine 10 is an excavator and machine 210 is a backhoe loader, though the invention is equally applicable to other types of material handling machines, for example tele-handlers.

As described above, the pair of lugs 112A, 112B are welded on the mounting plate 110. In alternative embodiments the bracket may be cast in the shape described.

As described above the flanges 72, 74 of the second plate 66 are of a generally uniform width. In alternative embodiments, each of the flanges may comprise a pair of lugs, each lug having at least one hole and the pair of lugs being connected by a lip that is formed when one of the side walls is welded to the first and second plates.

The invention claimed is:

1. An arm for a material handling machine comprising:

a first plate;

a second plate;

a pair of side walls;

the second plate having first and second edges opposite one another and a first of the pair of side walls is welded inward of the first edge of the second plate and a second of the pair of side walls is welded inward of the opposite edge of the second plate to form two flanges, each of the two flanges extending on opposite sides of the second plate and having a first end and a second end and including at least one hole extending therethrough adjacent each of the first and second ends; and wherein each of the flanges has a length that is longitudinal with respect to a length of the arm and a width that is transverse with respect to the arm, and wherein the length of each flange is between ⅓ and ⅙ of the length of the arm.

2. The arm for a material handling machine according to claim 1, wherein the first plate has two opposite edges and the first of the pair of side walls is welded inward of the first edge of the first plate and the second of the pair of side walls is welded inward of the opposite edge of the first plate.

3. The arm for a material handling machine according to claim 1, wherein the second plate has two opposite ends; wherein the first of the pair of side walls is welded inward of one edge to form a first lip between the first end of the second plate and a first end of a first of the two flanges and to form a second lip between a second end of the first of the two flanges and the second end of the second plate; and wherein the second of the pair of side walls is welded inward of the other edge to form a third lip between the first end of the second plate and a first end of a second of the two flanges and to form a fourth lip between a second end of the second of the two flanges and the second end of the second plate.

4. The arm according to claim 3, wherein each of the two flanges has a width and each of the four lips has a width and the width of the two flanges is greater than the width of at least one of the four lips.

5. The arm for a material handling machine according to claim 1, wherein the length of each flange is between ¼ and ⅕ of the length of the arm.

6. The arm for a material handling machine according to claim 1, wherein each of the two flanges has two holes adjacent each of its ends.

7. The arm for a material handling machine according to claim 6, wherein the two holes adjacent each end of each of the two flanges are arranged longitudinally with respect to the respective flange.

8. The arm for a material handling machine according to claim 6, wherein the distance between the two holes adiacent each end of each of the flanges is up to 1.95 m.

9. An arm according to claim 8, wherein the distance between the two holes at each end of each of the flanges is in the range of approximately 0.10 m to 0.45 m.

10. The arm for a material handling machine according to claim 6, wherein the distance between the two holes at each end of each of the flanges is approximately 20 mm to 70 mm.

11. The arm for a material handling machine according to claim 1 wherein the distance between the at least one hole adjacent each end of the flange and a weld line between the second plate and the side wall to which the second plate is welded is at least 5 mm.

12. An arm according to claim 11, wherein the distance between the at least one hole at each end of the flange and a weld line between the second plate and the side wall to which the second plate is welded is at least 10 mm.

13. The arm for a material handling machine according to claim 1, the arm having a first end for pivotable mounting of an implement and a second end for pivotable mounting to a further component of the material handling machine and wherein each of the flanges are positioned toward the second end of the arm.

14. The arm for a material handling machine according to claim 13 wherein a bucket is pivotably mounted at the first end of the arm, the bucket being movable in a crowd direction or a dump direction relative to the arm and the open face of the bucket generally faces the two flanges.

15. The arm for a material handling machine according to claim 1, wherein each of the two flanges has a width in the range 20 mm to 70 mm.

16. An arm according to claim 15, wherein each of the two flanges has a width in the range 25 mm to 35 mm.

17. A material handling machine including:

a chassis having a ground engaging propulsion structure;

a loading arm assembly pivotably mounted via a substantially horizontal axis to the machine;

the loading arm assembly including an arm, the arm including:

a first plate;

a second plate;

a pair of side walls;

a first pivot adjacent a first end of the arm and second pivot adjacent a second end of the arm;

the second plate having two opposite edges and a first of the pair of side walls is welded inward of the first edge of the second plate and a second of the pair of side walls is welded inward of the opposite edge of the second pate to form two flanges, the second plate extending from adjacent the first pivot to adjacent the second pivot, and the two flanges being integrally formed with the second plate from only a single piece of metal to form a unitary, non-welded component, each of the two flanges extending on opposite sides of the second plate and having at least one hole adjacent each of its ends; and wherein each of the flanges has a length that is longitudinal with respect to the arm and a width that is transverse with respect to the arm and the length of each flange is between ⅓ and ⅙ of the length of the arm.

18. The material handling machine according to claim 17, further comprising a body having a vertical axis wherein the arm is mounted on the body.

19. The material handling machine according to claim 18 wherein the ground engaging propulsion structure includes a pair of wheels or a continuous loop track at either side of the body.

20. The material handling machine according to claim 17 wherein the arm assembly includes a boom and the arm is pivotably mounted with respect to the boom.

* * * * *